US009523494B2

(12) United States Patent
Hayes

(10) Patent No.: US 9,523,494 B2
(45) Date of Patent: Dec. 20, 2016

(54) LED LIGHTING UNIT

(71) Applicant: Flextronics AP, LLC, San Jose, CA (US)

(72) Inventor: Earl James Hayes, South Lyon, MI (US)

(73) Assignee: Flextronics AP, LLC, San Jose, CA (US)

( * ) Notice: Subject to any disclaimer, the term of this patent is extended or adjusted under 35 U.S.C. 154(b) by 0 days.

(21) Appl. No.: 14/623,879

(22) Filed: Feb. 17, 2015

(65) Prior Publication Data

US 2016/0238231 A1 Aug. 18, 2016

(51) Int. Cl.

| | |
|---|---|
| ***H01J 7/24*** | (2006.01) |
| ***H01J 9/00*** | (2006.01) |
| ***F21V 29/00*** | (2015.01) |
| ***F21V 29/77*** | (2015.01) |
| ***F21V 19/00*** | (2006.01) |
| *F21Y 101/02* | (2006.01) |
| *F21Y 111/00* | (2016.01) |

(52) U.S. Cl.
CPC ..... *F21V 29/773* (2015.01); *F21V 19/0015* (2013.01); *F21Y 2101/02* (2013.01); *F21Y 2111/005* (2013.01); *F21Y 2111/007* (2013.01)

(58) Field of Classification Search
None
See application file for complete search history.

(56) References Cited

U.S. PATENT DOCUMENTS

| | | | | |
|---|---|---|---|---|
| 2005/0174780 | A1 | 8/2005 | Park | |
| 2012/0268936 | A1 | 10/2012 | Pickard et al. | |
| 2013/0188369 | A1* | 7/2013 | Chien | F21K 9/135 362/363 |
| 2014/0240990 | A1 | 8/2014 | Bae | |
| 2014/0268739 | A1* | 9/2014 | Veres | F21V 29/83 362/235 |
| 2014/0321126 | A1* | 10/2014 | Narag | H05K 1/189 362/306 |

(Continued)

FOREIGN PATENT DOCUMENTS

| | | | |
|---|---|---|---|
| EP | 1046859 | A1 | 10/2000 |
| EP | 2650589 | A1 | 10/2013 |

(Continued)

OTHER PUBLICATIONS

MULTEK, Product Bulletin, 2 pgs. (Jan. 29, 2014) available at http://www.multek.com/Technology/Files/Q-Prime%20Product%20Bulletin%20REV%20B.pdf (last visited May 18, 2015).

*Primary Examiner* — Ashok Patel
(74) *Attorney, Agent, or Firm* — Volpe & Koenig, P.C.

(57) ABSTRACT

An LED lighting unit may include a flexible circuit substrate having a an obverse side and a reverse side. The obverse side may include a plurality of mounting points for LEDs and the reverse side may include a thermal conduction material. A plurality of LEDs may be mounted to the plurality of mounting points and may be in thermal communication with the thermal conduction material. A heat sink may be attached to the reverse side of the substrate and may have a hollow conical-frustum geometry. The heat sink may include a top circumference, a bottom circumference, a top opening, a bottom opening, at least one cooling fin extending into an interior of the heat sink.

14 Claims, 5 Drawing Sheets

(56) References Cited

U.S. PATENT DOCUMENTS

2014/0369038 A1* 12/2014 Tischler ..... F21V 21/14
362/235

FOREIGN PATENT DOCUMENTS

| | | | |
|---|---|---|---|
| EP | 2778503 | A2 | 9/2014 |
| JP | 2009289649 | A | 12/2009 |
| WO | 2011160452 | A1 | 12/2011 |

* cited by examiner

LED LIGHTING UNIT

FIELD OF INVENTION

The invention relates to LED lighting in general and to a lighting unit for managing heat dissipation from light-emitting diodes (LEDs) in particular.

BACKGROUND

An LED is a semiconductor light source. LEDs are increasingly being used in a wide variety of lighting applications, and are growing in popularity due in part to their efficiency, reliability, and service lifetimes.

High bay lighting applications may include light structures designed for use in buildings with high ceilings, or "high bays" such as warehouses, manufacturing facilities, or the like where the ceilings can be 30-40 feet high for example. High bay facilities typically mount lighting devices at or near the ceiling. Accordingly, high-power LEDs (for example, LEDs dissipating in excess of 1 watt) may be used with such devices in order to provide sufficient illumination.

However, high-power LEDs generate a considerable amount of heat which must be managed in order to prevent premature failure and increase efficiency. It may be desirable therefore to provide a light fixture which addresses these issues.

SUMMARY

A LED lighting unit may include a flexible circuit substrate having a an obverse side and a reverse side. The obverse side may include a plurality of mounting points for LEDs and the reverse side may include a thermal conduction material. A plurality of LEDs may be mounted to the plurality of mounting points and may be in thermal communication with the thermal conduction material. A heat sink may be attached to the reverse side of the substrate and may have a hollow conical-frustum geometry. The heat sink may include a top circumference, a bottom circumference, a top opening, a bottom opening, at least one cooling fin extending into an interior of the heat sink.

DETAILED DESCRIPTION OF THE PREFERRED EMBODIMENTS

A combination of one or more LED modules together with an LED driver (also known as electronic control gear, or ECG) may be referred to as a LED light engine (LLE). An LLE may include an integrated driver, or may include one or more LED modules together with a separate driver. An LLE may be integrated into a luminaire or light fixture, or may be a replaceable element. The luminaire or light fixture may include secondary optical elements such as lenses, shades, diffusers, filters, and reflectors, or mechanical elements to modify light output from the LLE. An LED lighting element intended for direct replacement of a conventional lamp (such as an incandescent lamp) may be referred to as an LED lamp. An LED lamp may not require secondary optical or mechanical elements to modify the LED lamp light output.

A unit containing one or more LEDs supplied as a light source may be referred to as an LED module. The term LED module does not include the LED driver. An LED driver or ECG may be located between the power supply and one or more LED modules to provide the LED module or modules with suitable voltage or current. An LED driver may include one or several separate components, and may include additional functionality such as dimming, power-factor correction, or radio interference suppression, for example.

LLEs, LED lamps, and LED modules may be referred to generally as LED lighting units.

Figure 1:
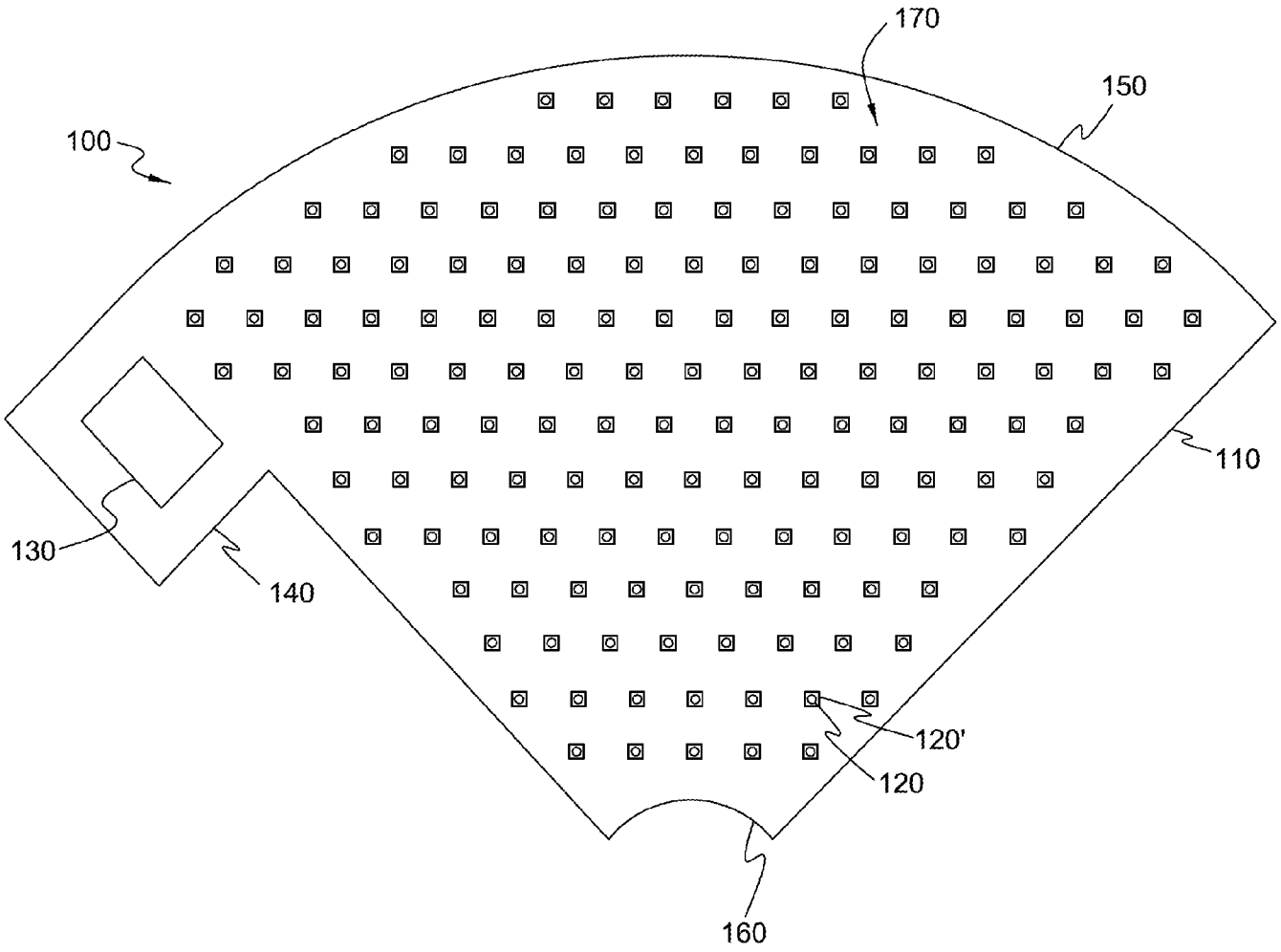
FIG. 1 is a plan view of an example LED lighting unit.

FIG. 1 illustrates an example LED lighting unit 100 which includes a circuit substrate 110 and LEDs 120. Substrate 110 includes an LED driver 130 disposed on a tab 140, a top edge 150, and a bottom edge 160.

Substrate 110 may be flexible and have a shape and dimensions suitable for wrapping around, fitting over, or otherwise enveloping heat sink 200 (FIG. 2). Substrate 110 may include mounting points 120', on a top surface 170. Mounting points 120' may provide electrical connections and/or thermal interfaces for LEDs 120. For example, each mounting point 120' may provide an electrical connection such as a solder point for an LED 120, which is in electrical communication with one or more electrical conductor traces (not shown) or other suitable conduction elements disposed on surface 170 or within substrate 110. Each mounting point 120' may provide a thermal interface, such as a polymer or other suitable insulating or dielectric layer, between LEDs 120 and a heat conductive layer (not shown) disposed on a reverse side (not shown) of, or within, substrate 110 which resists electrical conduction but permits or promotes thermal conduction between LEDs 120 and the heat conductive layer. The heat conductive layer may be flexible and may include a layer of aluminum or other suitable heat conducting material. Substrate 110 may include a commercially available circuit substrate such as Multek® Q-Prime®. It is noted that in some implementations circuit substrate 110 may be substantially non-flexible.

LEDs 120 may include high-power LEDs (i.e. LEDs each dissipating in excess of 1 watt) typical for illumination applications. LEDs 120 may be arranged on the surface of substrate 110 and may be interconnected via mount points 120' in one or more series and/or parallel circuits (not shown) with LED driver 130. In some implementations LEDs 120 may be arranged in a pattern configured to optimize heat dissipation, light transmission, and/or heat conduction with the heat conductive layer of substrate 110 and/or heat sink 200 (FIGS. 2A, 2B, 2C) as discussed further herein.

LED driver 130 may include circuitry for controlling and/or powering LEDs 120 and may include at least one integrated circuit and/or power supply. LED driver 130 may include one or more power connections, power converters, LED driver circuits, dimmers, remote control sensors, or other LED driver circuitry for powering and/or controlling LEDs 120. It is noted that in some implementations LED driver 130 may be separate from substrate 110 or otherwise not included in lighting unit 100. In such case LED lighting unit 100 may be considered an LED module.

Figure 2B:
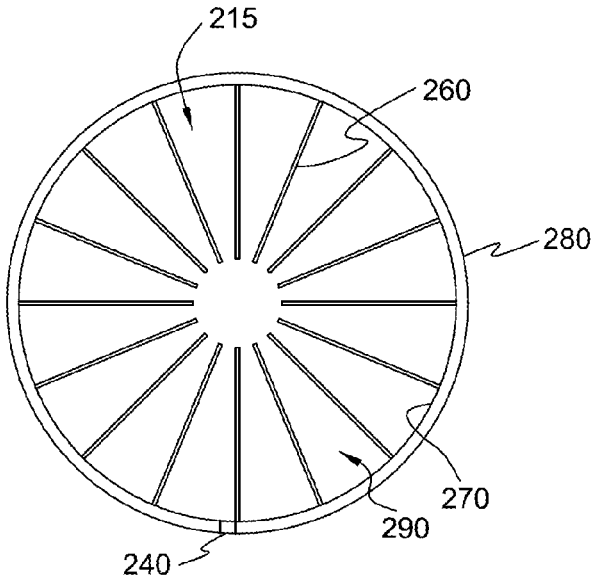
FIGS. 2A, 2B, and 2C are side top and bottom views of a heat sink usable with the LED lighting unit of FIG. 1.
Figure 2A:
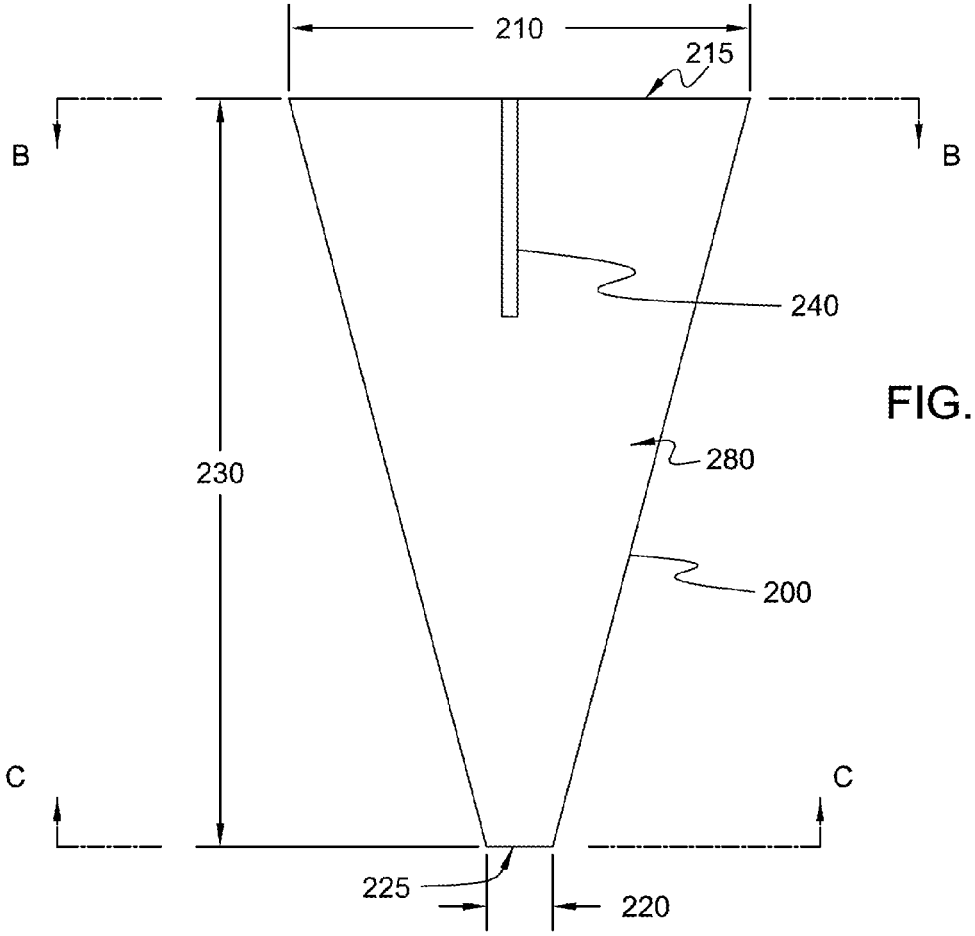

FIG. 2A illustrates a heat sink 200 having a hollow conical frustum geometry. Heat sink 200 has a top diameter 210, top opening 215, base diameter 220, base opening 225, and height 230. Heat sink 200 also includes a slot 240. It is noted that in some implementations slot 240 may be omitted. Top diameter 210 is greater than bottom diameter 220, and accordingly top opening 215 is larger than bottom opening 225. Heat sink 200 may be made partly or entirely from aluminum or another suitable heat sink material and may be cast, formed from sheet, partly cast and partly formed from sheet, or constructed using another suitable technique.

Figure 2C:
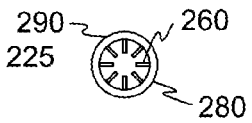

FIG. 2B is a top view of heat sink 200 illustrating cooling fins 260, inside surface 270, outside surface 280, and interior 290 through top opening 215. FIG. 2C is a bottom view of heat sink 200 illustrating these components through bottom opening 225. Cooling fins 260 may be formed in one piece with heat sink 200 or may be formed separately and attached to heat sink 200. Cooling fins 260 extend from inside surface 270 into interior 290, and may extend different distances into interior 290 as shown. One of the cooling fins 260 may be positioned adjacent to slot 240 in some implementations for positioning or attachment of tab 140 as further discussed herein.

Figure 3:
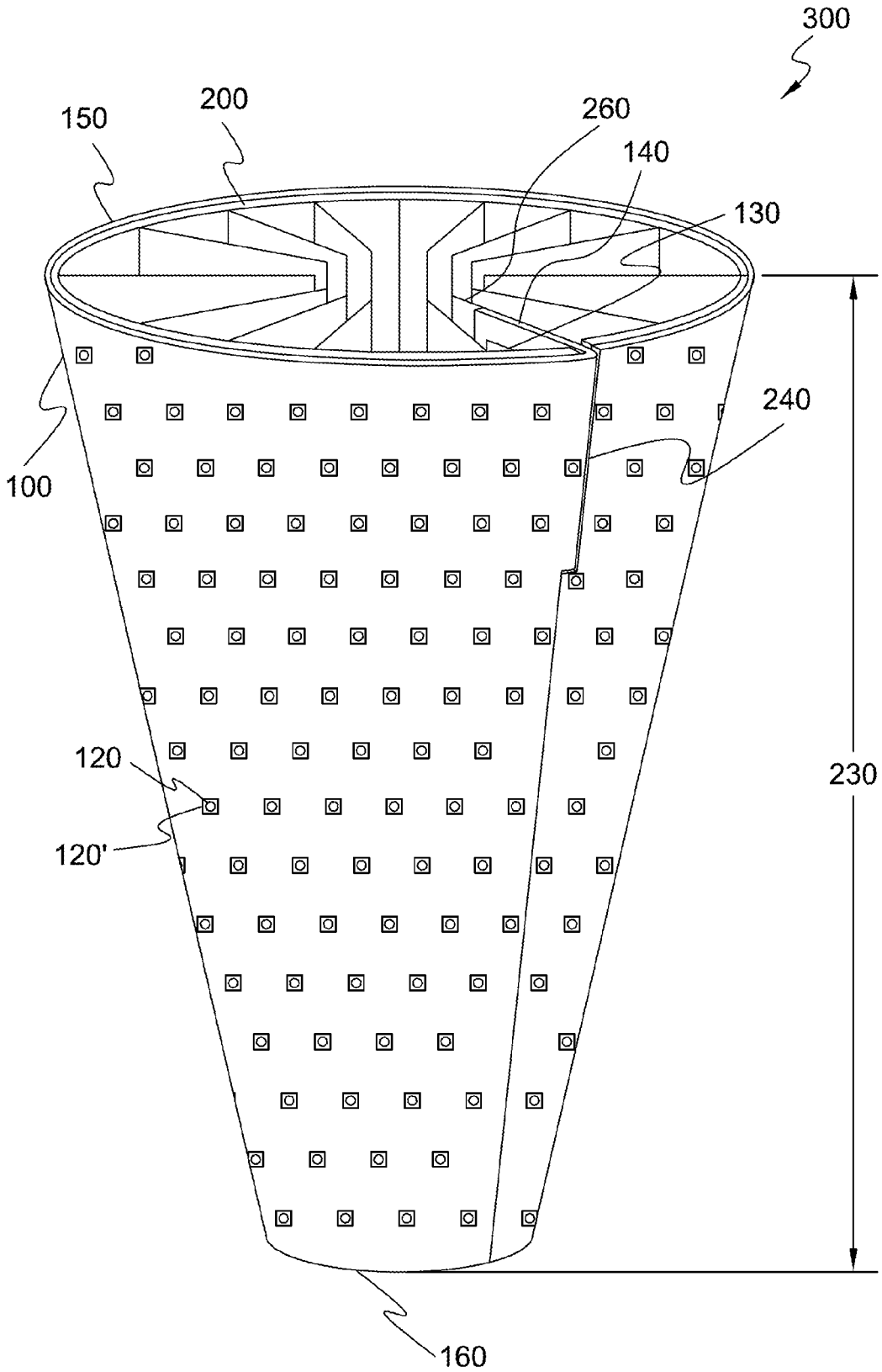
FIG. 3 is a perspective view illustrating a combination of the LED light unit shown in FIG. 1 and the heat sink shown in FIGS. 2A, 2B, and 2C.

FIG. 3 is a perspective view of LED lighting element 100 mounted to heat sink 200. Lighting element 100 may be mounted to heat sink 200 using a pressure sensitive adhesive (PSA), thermal compound, fasteners, heat staking, ultrasonic welding, and/or other suitable elements or techniques (not shown). Tab 140 is shown inserted into slot 240 such that tab 140 and LED driver 130 extend into interior 290 of heat sink 200. Tab 140 is shown affixed to one of cooling fins 260. This positioning of tab 140 and LED driver 130 may provide for improved heat dissipation from LED driver 130. In some implementations, tab 140 may extend into interior 290 without being affixed to a cooling fin. In some implementations, tab 140 and/or slot 240 may be omitted.

During operation, LEDs 120 may generate heat which may be conducted to heat sink 200 via mounting points 120 and/or substrate 110. The heat from LEDs 120 may in turn be conducted to cooling fins 260. Air within the interior 290 of heat sink 200 may increase in temperature due to the heat conducted from LEDs 120. As the temperature of the air within interior 290 increases, it may expand, rise, and exit through the top opening 215 of heat sink 200. This may be caused or assisted by a chimney effect and/or otherwise by the geometry of heat sink 200, and may depend upon the geometry of heat sink 200, heat generated by LEDs 120, ambient conditions, and/or other considerations.

For example, the conical frustum geometry of heat sink 200 may permit air expanding due to heating within interior 290 to more easily exit through the top opening 215. Further, the buoyancy of the heated air within interior 290 may cause it to rise out of the top opening 215. Still further, a difference in air pressure between the heated air inside heat sink 200 and the air outside heat sink 200 may cause the air to be drawn in bottom opening 225, through heat sink 200, and out top opening 215.

This effect or combination of effects may cause cooler air to enter into the bottom opening 225, and the convection of heated air out of the top opening 215 and of cooler air into the bottom opening 225 may facilitate heat transfer from LEDs 120 to the outside air via heat sink 200 and cooling fins 260. This may have the advantage of providing increased cooling without the need for an active cooling element such as a fan. In some implementations however, a fan (not shown) may be disposed to create or increase air flow through heat sink 200.

Figure 4:
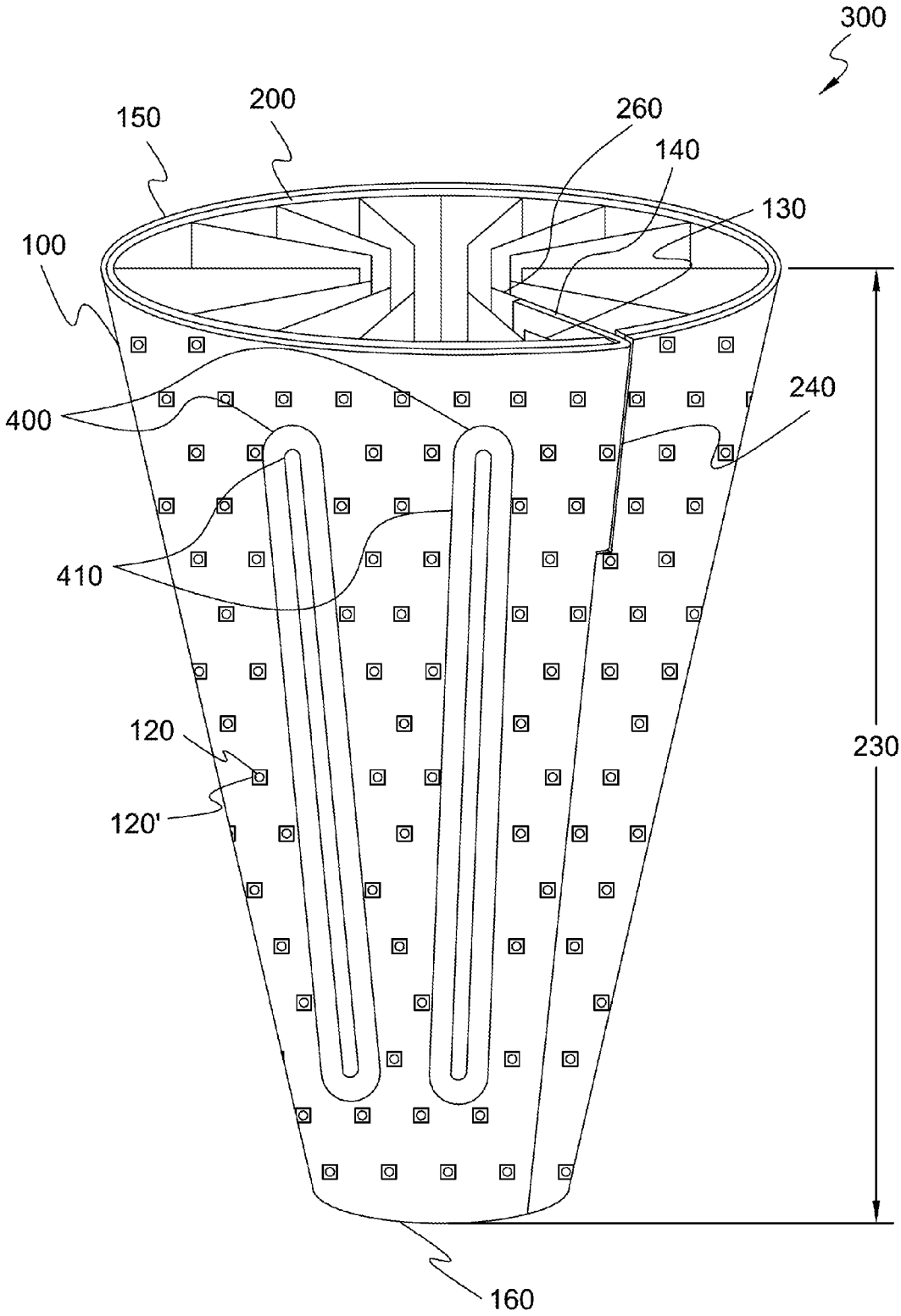
FIG. 4 is a perspective view of the combination shown in FIG. 3 showing additional features.

FIG. 4 is a perspective view of LED lighting element 100 mounted to heat sink 200 as shown in FIG. 3, illustrating additional features. In FIG. 4, LED lighting element 100 includes openings 400, and heat sink 200 includes protrusions 410. Protrusions 410 are shown as ribs in FIG. 4, however such protrusions may include other geometries as desired, and openings 400 may be sized and shaped to accommodate protrusions 400 accordingly. Protrusions 410 may have the advantage of increasing heat dissipation by increasing the amount of surface area of heat sink 200 which may contact air outside of heat sink 200.

Figure 5:
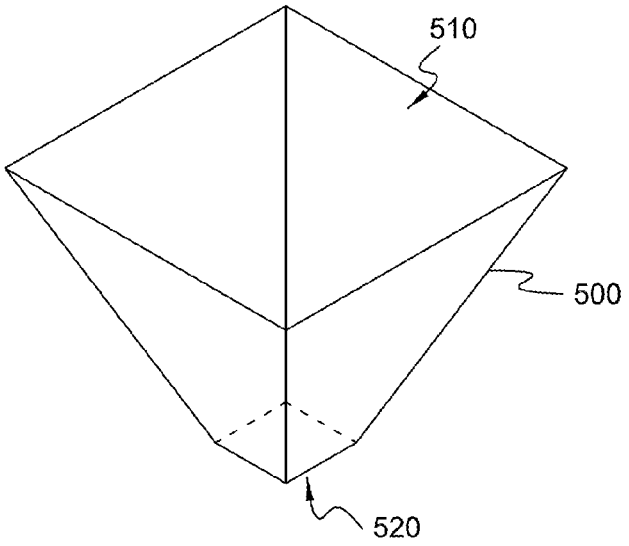
FIG. 5 is a perspective view of an alternative geometry for the heat sink shown in FIG. 2.
Figure 6:
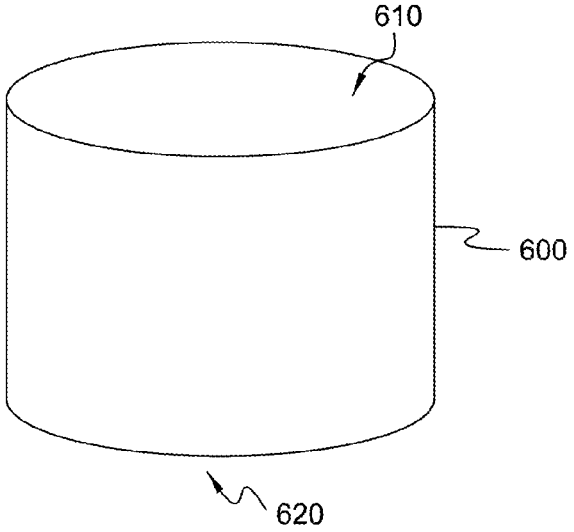
FIG. 6 is a perspective view of another alternative geometry for the heat sink shown in FIG. 2.
Figure 7:
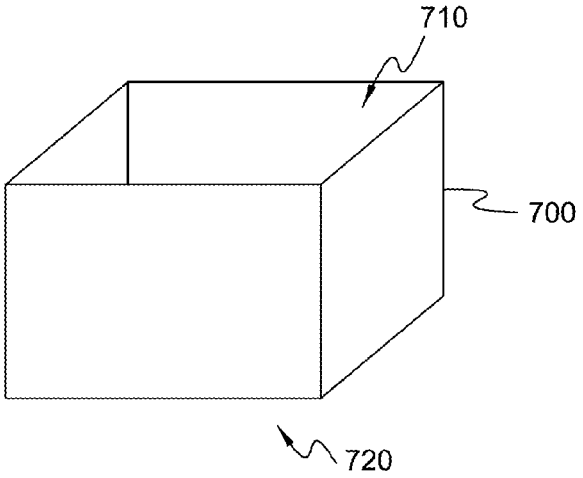
FIG. 7 is a perspective view of another alternative geometry for the heat sink shown in FIG. 2.

FIGS. 5, 6, and 7 illustrate heat sinks 500, 600, and 700 having top openings 510, 610, 710 and bottom openings 520, 530, and 540 respectively. Heat sinks 500, 600, and 700 are heat sink geometries which may be used as alternatives to the conical frustum geometry of heat sink 200 (FIGS. 2A, 2B, 2C, 3, 4). Heat sink 500 illustrates a non-conical frustum, heat sink 600 illustrates a cylinder, and heat sink 700 illustrates a square prism for example, and it is noted that other geometries may be used, such as rectangular or non-square polygonal prisms or frustums (not shown). Opening 510 is larger than opening 520, while opening 610 is the same size as opening 620 and opening 710 is the same size as opening 720. The dimensions and LED layout of an LED lighting unit (not shown) which is similar to LED lighting unit 100 (FIG. 1) may specified for each of heat sinks 500, 600, and 700. Such LED lighting units may be mounted to heat sinks 500, 600, and 700 accordingly to form a combination (not shown) similar to the combination of heat sink 200 and LED lighting unit 100 shown and described with respect to FIG. 3.

Although features and elements are described above in particular combinations, one of ordinary skill in the art will appreciate that each feature or element can be used alone or in any combination with the other features and elements.

What is claimed is:

1. A lighting unit comprising:

a flexible circuit substrate having a an obverse side and a reverse side, the obverse side including a plurality of mounting points for light emitting diodes (LEDs) and the reverse side including a thermal conduction material;

a plurality of LEDs mounted to the plurality of mounting points and in thermal communication with the thermal conduction material;

a heat sink having a hollow conical-frustum geometry, a top circumference, a bottom circumference, a top opening, a bottom opening, at least one cooling fin extending into an interior of the heat sink, and an exterior surface which is attached to the reverse side of the substrate, wherein the bottom circumference is less than the top circumference;

an LED driver disposed on a tab of the substrate;

wherein the heat sink comprises a slot and wherein the tab is inserted into the slot such that the LED driver is disposed inside the interior of the heat sink.

2. The lighting unit of claim 1, wherein the tab is affixed to at least one cooling fin.

3. The lighting unit of claim 1, wherein the exterior surface of the heat sink comprises a projection which extends through an opening in the substrate.

4. A lighting unit comprising:

a circuit substrate having an obverse side which includes a plurality of mounting points for light emitting diodes (LEDs); and a heat sink having a hollow geometry which includes at least one cooling fin projecting into an interior of the heat sink and an exterior surface which is bonded to a reverse side of the substrate;

wherein a bottom circumference of the heat sink is less than a top circumference of the heat sink;

a controller disposed on a tab if the substrate;

wherein the heat sink comprises a slot and wherein the tab is inserted into the slot such that the controller is disposed inside the interior of the heat sink.

5. The lighting unit of claim 4, wherein the circuit substrate comprises a reverse side which includes a thermal conduction material.

6. The lighting unit of claim 5, wherein the mounting points each comprise a thermal interface between one at least one LED and the thermal conduction material.

7. The lighting unit of claim 4, further comprising a thermal compound or thermal adhesive disposed between the exterior surface of the heat sink and the reverse side of the substrate.

8. The lighting unit of claim 4, wherein the heat sink comprises at least one fin extending into an interior of the heat sink.

9. The lighting unit of claim 4, wherein the heat sink comprises a conical frustum geometry.

10. The light fixture of claim 4, wherein the heat sink comprises a frustum, cylinder, or prism geometry.

11. The light fixture of claim 4, wherein substrate comprises at least one opening and the heat sink comprises at least one protrusion which projects through the at least one opening.

12. A method for heat dissipation in a lighting unit which comprises:

providing a flexible circuit substrate having an obverse side and a reverse side, the obverse side including a plurality of mounting points for light emitting diodes (LEDs) and the reverse side including a thermal conduction material;

mounting a plurality of LEDs to the plurality of mounting points and in thermal communication with the thermal conduction material; and attaching a heat sink to a the reverse side of the substrate, the heat sink having a hollow conical-frustum geometry, a top circumference, a bottom circumference, a top opening, a bottom opening, at least one cooling fin extending into an interior of the heat sink, wherein the bottom circumference is less than the top circumference;

an LED driver disposed on a tab of the substrate;

wherein the heat sink comprises a slot and wherein the tab is inserted into the slot such that the LED driver is disposed inside the interior of the heat sink.

13. The method of claim 12, further comprising affixing the tab to at least one cooling fin.

14. The method of claim 12, wherein the exterior surface of the heat sink comprises a projection which extends through an opening in the substrate.

* * * * *